United States Patent [19]

Davis

[11] 4,100,910

[45] Jul. 18, 1978

[54] PRESSURE RATIO VALVE

[75] Inventor: Bill G. Davis, Phoenix, Ariz.

[73] Assignee: Jetco, Inc., Phoenix, Ariz.

[21] Appl. No.: 778,851

[22] Filed: Mar. 18, 1977

[51] Int. Cl.[2] ..... F01M 1/00; F01M 1/18

[52] U.S. Cl. ..... 123/196 S; 184/6.4; 123/198 D; 123/198 DB

[58] Field of Search ..... 123/196 S, 198 D, 198 DB, 123/198 DC; 184/6.4, 6.5

[56] References Cited

U.S. PATENT DOCUMENTS

| | | | |
|---|---|---|---|
| 3,590,798 | 7/1971 | Goodwin | 123/198 D |
| 3,913,551 | 10/1975 | Shaver | 123/198 DB |

*Primary Examiner*—Ronald H. Lazarus

*Attorney, Agent, or Firm*—Cahill, Sutton & Thomas

[57] ABSTRACT

A pressure ratio valve is installed in an engine having an engine protection means for reducing the engine RPM to a safe level in response to an engine oil pressure below an acceptable level. The engine further includes a fuel pump for supplying fuel at a pressure linearly related to the engine RPM. The pressure ratio valve continuously senses both the oil pressure and the fuel pressure of the engine and reduces the engine oil pressure below the acceptable level of the engine protection means in response to a fuel pressure-oil pressure ratio in excess of a predetermined magnitude. This action by the pressure ratio valve causes the engine protection means to reduce the engine RPM to a safe level.

10 Claims, 4 Drawing Figures

PRESSURE RATIO VALVE

BACKGROUND OF THE INVENTION

1. Field of the Invention

This invention relates to valves, and more particularly, to pressure ratio valves for controlling the flow of a first fluid in response to the ratio of the pressures of first and second fluids.

2. Description of the Prior Art

In the operation of internal combustion engines it is frequently desirable to provide protection means for automatically stopping the engine when certain conditions occur which would be detrimental to the engine. To provide such protection, devices have been designed which are responsive to oil pressure to block the passage of fuel to the engine when the oil pressure drops below a minimum acceptable level. A device of this type is disclosed in my commonly assigned U.S. patent application Ser. No. 680,576, entitled "Fuel Shut-Off Valve". However, such devices sense only oil pressure, whereas engine damage can occur when the oil pressure decreases to a point below its normal pressure but above the minimum acceptable level or when the engine RPM exceeds the maximum safe limit so that the engine lubrication system cannot provide the necessary lubrication. Devices which shut down the engine only in response to a dangerously low oil pressure will not alleviate these problems since it is the lessened ratio of engine RPM to oil pressure which is the source of the problem. An engine operated at an RPM above its red line can be permanently damaged in a very brief period of time due to insufficient lubrication if not shut down. Similarly, an engine can be damaged by sustained operation when the oil pressure is below normal but above the minimum acceptable level which would shut the engine down.

SUMMARY OF THE INVENTION

It is therefore a primary object of the present invention to provide a pressure ratio valve which will activate an engine protection means to reduce the engine RPM to a safe level when the pressure ratio valve senses a fuel pressure-oil pressure ratio in excess of a predetermined magnitude.

Another object of the present invention is to provide a pressure ratio valve which is readily installed in an existing engine.

Yet another object of the present invention is to provide a pressure ratio valve which has a single moving part.

Still another object of the present invention is to provide a pressure ratio valve which has a near zero failure rate.

Briefly stated, and in accord with one embodiment of the invention, a pressure ratio valve is provided for use in an engine having engine protection means for reducing the engine RPM to a safe level in response to an oil pressure below an acceptable level, and a fuel pump for supplying fuel at a pressure linearly related to the engine RPM. The pressure ratio valve continuously senses both the oil pressure and the fuel pressure of the engine. The pressure ratio valve reduces the engine oil pressure below the acceptable level for the engine protection means whenever the fuel pressure-oil pressure ratio exceeds a predetermined magnitude. When the oil pressure drops below the acceptable level, the engine protection means reduces the engine RPM to a safe level, thus preventing substantial mechanical damage to the engine.

DESCRIPTION OF THE DRAWING

The invention is pointed out with particularity in the appended claims. However, other objects and advantages, together with the operation of the invention, may be better understood by reference to the following detailed description taken in connection with the following illustrations wherein:

DESCRIPTION OF THE PREFERRED EMBODIMENT

Figure 2:
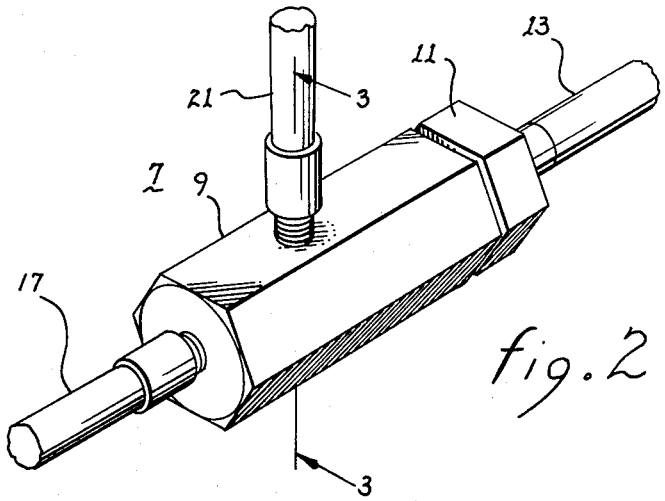
FIG. 2 is a perspective view of the pressure ratio valve of the present invention.

In order to better illustrate the advantages of the invention and its contributions to the art, a preferred hardware embodiment of the invention will now be described in some detail.

The general operating characteristics of the invention will be described first by reference to the graph shown in FIG. 1. The X-axis of the graph represents the magnitude of the engine oil pressure while the Y-axis of the graph indicates the magnitude of the engine fuel pressure. It is a requirement of the present invention that the engine fuel pump produce an output pressure which increases linearly with the RPM of the engine. A fuel pump having this characteristic is manufactured by the Cummins Diesel Engine Company. On the graph the line indicated by reference numeral 1 indicates the maximum desired fuel pressure-oil pressure ratio for a particular engine. Since the output pressure of the fuel pump is linearly related to the engine RPM, the fuel pressure-oil pressure ratio is equivalent to an RPM-oil pressure ratio. As can be seen from FIG. 1, whenever the engine fuel pressure-oil pressure ratio falls in the region above the line indicated by reference numeral 1, the engine is operating in an undesirable or unsafe region. The pressure ratio valve will open causing the engine oil pressure to be reduced to a level sufficient to actuate the engine protection means, such as a fuel shut-off valve described in my copending patent application Ser. No. 680,576, to either shut down the engine or to reduce the engine RPM to a safe level. Whenever the engine fuel pressure-oil pressure ratio lies in the region below the line indicated by reference numeral 1, the engine is operating in a safe region and the pressure ratio valve will remain closed, thus maintaining the engine oil pressure at the existing level.

Assume that reference numeral 3 designates the range of normal fuel pressure-oil pressure ratios for a particular engine. Since this line lies in a region below the line designated by reference numeral 1, the engine is operating in a safe region and will not be disturbed by the pressure ratio valve. The point along line 3 indicated by "A" indicates that the engine is operating a particular RPM with a normal oil pressure. If the engine RPM is decreased and the pressure ratio is that indicated by point "B", the fuel pressure-oil pressure ratio will still remain within the safe region and engine operation will not be affected by the pressure ratio valve.

If the engine is operating at point "A" and part of its lubrication system becomes obstructed causing the engine oil pressure to be reduced, the fuel pressure-oil pressure ratio will move toward point "C". This reduction in oil pressure causes a horizontal translation of the pressure ratio from point "A" to point "C" since the engine RPM would be unaffected by a decrease in engine oil pressure. Without the pressure ratio valve the engine would continue to operate normally at point "C" as long as the oil pressure remained above the threshold level for activating the engine protection means.

If a pressure ratio valve is included in the engine system, at the position indicated by reference "5" the fuel pressure-oil pressure ratio will reach the maximum permissible ratio which will cause the pressure ratio valve to be activated. As the valve is activated the engine oil pressure will be reduced to a level sufficient to actuate the engine protection means which will reduce the engine RPM to a safe level.

If the engine has been operating within the safe region at a point indicated by "A" and an obstruction in the fuel pump caused the fuel pressure to be decreased to a level below normal, the fuel pressure-oil pressure ratio would move from point "A" to point "D" which is still within the safe region. Since the oil pressure has not been affected, it is unnecessary to compensate for a reduction in fuel pressure. The probable result of a reduction in fuel pressure is in fact a reduction in engine RPM. It is likely that an insufficient amount of fuel will then be delivered to the engine at the lower fuel pressure to allow it to continue operating its normal RPM.

Figure 3:
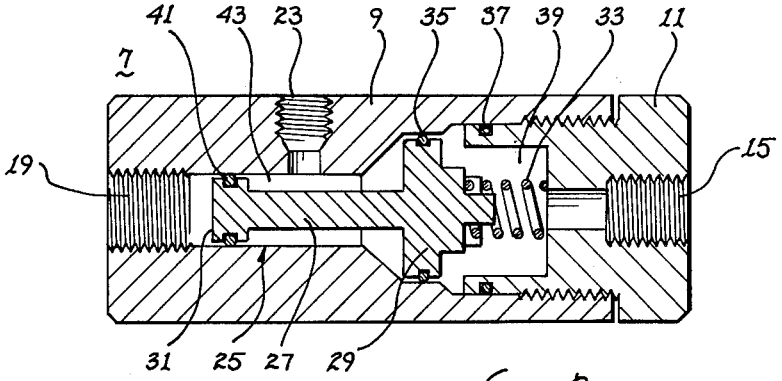
FIG. 3 is a sectional view of the pressure ratio valve of FIG. 2 in the closed position, taken along line 3—3.

Referring now to FIGS. 2 and 3, pressure ratio valve 7 consists of a longitudinal body 9 which includes an end cap 11. An oil pressure line 13 couples oil pressure port 15 to an oil flow restriction fitting (not shown) which connects oil pressure line 13 to the pressurized portion of the engine oil system. The oil flow restriction fitting has an orifice substantially smaller than the oil line diameter and causes a small oil flow to create a substantial oil pressure drop. Fuel pressure line 17 couples fuel pressure port 19 to the output of the engine driven fuel pump. Oil dump line 21 couples oil outlet port 23 to a low pressure engine oil reservoir such as the engine crankcase. An engine protection means, such as the "Fuel Shut-Off Valve" described in my copending U.S. patent application Ser. No. 680,576, is connected to oil pressure line 13 to sense the oil pressure in that line.

A multiple diameter, longitudinally extending bore 25 is located within pressure ratio valve 7. Piston 27 is positioned within bore 25 and is longitudinally displaceable therein. Piston 27 includes first pressure receiving head 29 which receives oil under pressure from oil pressure port 15 and a second pressure receiving head 31 which receives fuel under pressure from fuel pressure port 19. A spring or biasing means 33 is placed between the inner surface of end cap 11 and first pressure receiving head 29. Biasing means 33 exerts a predetermined force which urges piston 27 into a first or closed position as shown in FIG. 3. In the first position shown in FIG. 3 O-ring 35 provides a positive seal between first pressure receiving head 29 and bore 25 of pressure ratio valve 7. O-ring 37 provides a positive seal between end cap 11 and bore 25. O-rings 35 and 37 prevent oil received from oil pressure port 15 from leaking out of chamber 39. O-ring 41 prevents fuel from fuel pressure port 19 from leaking into chamber 43.

Figure 4:
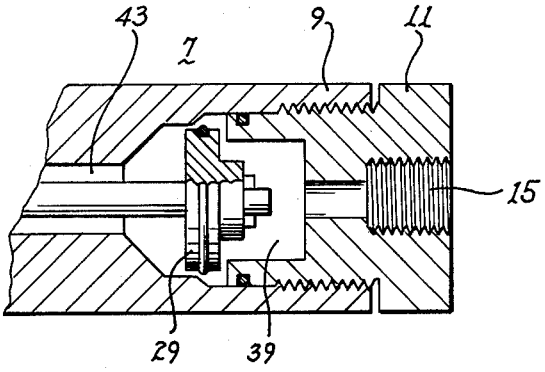
FIG. 4 is a partial sectional view of the pressure ratio valve of FIG. 3 in the open position.

When the force upon second pressure receiving head 31 exceeds the force exerted by the oil under pressure on the first pressure receiving head 29 plus the force attributable to biasing means 33, piston 7 is displaced into a second position as shown in FIG. 4. In this second position, O-ring 35 is no longer in close contact with bore 25 and oil from oil pressure port 15 is able to freely pass from chamber 39 into chamber 43. Since O-ring 41 prevents the oil within chamber 43 from flowing into fuel pressure port 19, the oil passes through oil outlet port 23 into oil dump line 21. Since oil dump line 21 provides a low pressure path back to the engine oil reservoir, the engine oil flows through the oil flow restriction fitting which causes the oil pressure in oil pressure line 13 to rapidly drop below the activation threshold of the engine protection means which is thereby activated, reducing the engine RPM to a safe level.

Figure 1:
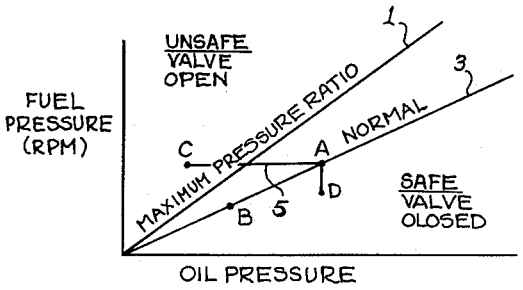
FIG. 1 is a graph illustrating the operational characteristics of an engine shut-down system incorporating a pressure ratio valve of the present invention.

The force provided by biasing means 33 and the relative areas of first pressure receiving head 29 and second pressure receiving head 31 determine the slope of line 1 in FIG. 1 which indicates the maximum allowable fuel pressure-oil pressure ratio. Altering the strength of biasing means 33 or the areas of either of the pressure receiving heads changes the pressure ratio at which pressure ratio valve 7 will be actuated.

It will be apparent to those skilled in the art that the disclosed pressure ratio valve may be modified in numerous ways and may assume many embodiments other than the preferred form specifically set out and described above. Accordingly, it is intended by the appended claims to cover all such modifications of the invention which fall within the true spirit and scope of the invention.

What is claimed is:

1. In an engine having engine protection means for reducing the engine RPM to a safe level in response to an engine oil pressure below an acceptable level, and a fuel pump for supplying fuel at a pressure linearly related to the engine RPM, a valve for continuously sensing both the oil pressure and the fuel pressure of the engine, and for reducing the engine oil pressure below the acceptable level in response to a fuel pressure-oil pressure ratio in excess of a predetermined magnitude, said valve comprising in combination:

a. a body defining an internal, longitudinally extending bore;

b. an oil inlet port providing a passage for entry of oil under pressure into said bore;

c. a fuel inlet port providing a passage for entry of fuel under pressure into said bore;

d. an oil outlet port communicating with said bore;

e. a piston slidably moveable in said bore interposed between said oil inlet port and said fuel inlet port, said piston having a first pressure receiving heat communicating with said oil inlet port and a second pressure receiving head communicating with said fuel inlet port, said piston having a first position wherein said first pressure receiving head is in blocking relationship between said oil inlet port and said oil outlet port, and a second position wherein said first pressure receiving head is in non-blocking relationship between said oil inlet port and said oil outlet port, and f. biasing means exerting a predetermined force urging said piston into the first position, said predetermined force being sufficient to maintain said piston in the first position so long as the force exerted by the fuel under pressure on said second pressure receiving head does not exceed the combination of said predetermined force and the force exerted by said oil under pressure on said first pressure receiving head;

whereby said piston is urged into the second position when the fuel pressure-oil pressure ratio exceeds the predetermined magnitude for reducing the engine oil pressure below the acceptable level and thereby activating the engine protection means.

2. The apparatus of claim 1 wherein said biasing means includes a spring.

3. The apparatus of claim 1 wherein the engine further includes a crankcase and an oil dump line and wherein said oil dump line couples said oil outlet port to the crankcase for returning oil flowing from said oil outlet port to the crankcase.

4. The apparatus of claim 1 further including first and second radially inwardly extending annular surfaces dividing said bore into first, second and third sections.

5. The apparatus of claim 4 wherein said first pressure receiving head is longitudinally displaceable between said first and said second sections.

6. The apparatus of claim 5 wherein said second pressure receiving head is longitudinally displaceable within said third section.

7. The apparatus of claim 6 further including first annular sealing means positioned around the circumference of said second pressure receiving head to prevent fuel from passing from said fuel pressure port into said oil outlet port.

8. The apparatus of claim 7 further including second annular sealing means positioned around the circumference of said first pressure receiving head for preventing oil from passing from said oil inlet port to said oil outlet port when said piston is maintained in the first position.

9. The apparatus of claim 8 wherein said first annular sealing means includes an annular groove in said second pressure receiving head having an O-ring therein for slidably engaging said bore.

10. The apparatus of claim 9 wherein said second annular sealing means includes an annular groove in said first pressure receiving head having an O-ring therein for slidably engaging said bore.

* * * * *